US011045065B2

(12) United States Patent
Hofmann et al.

(10) Patent No.: US 11,045,065 B2
(45) Date of Patent: Jun. 29, 2021

(54) DISHWASHING APPLIANCES WITH HOT START FEATURES AND RELATED METHODS

(71) Applicant: Haier US Appliance Solutions, Inc., Wilmington, DE (US)

(72) Inventors: Adam Christopher Hofmann, Louisville, KY (US); Paul Edward Newsom, II, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 28 days.

(21) Appl. No.: 16/672,934

(22) Filed: Nov. 4, 2019

(65) Prior Publication Data

US 2021/0127939 A1 May 6, 2021

(51) Int. Cl.
*A47L 15/00* (2006.01)

(52) U.S. Cl.
CPC ..... *A47L 15/0047* (2013.01); *A47L 2401/12* (2013.01); *A47L 2501/06* (2013.01); *A47L 2501/28* (2013.01)

(58) Field of Classification Search
CPC ..... A47L 15/0047; A47L 2401/12; A47L 2501/06; A47L 2501/28
See application file for complete search history.

(56) References Cited

U.S. PATENT DOCUMENTS 6,622,754 B1 * 9/2003 Roth ..... A47L 15/4295 134/18
8,801,862 B2 8/2014 Graven
2012/0060875 A1 * 3/2012 Fauth ..... A47L 15/4295 134/56 D

FOREIGN PATENT DOCUMENTS

EP 3375344 A1 9/2018
JP H04367642 A 12/1992

* cited by examiner

*Primary Examiner* — Sharidan Carrillo
(74) *Attorney, Agent, or Firm* — Dority & Manning, P.A.

(57) ABSTRACT

A method of operating a dishwashing appliance includes filling the sump of the dishwashing appliance with an initial fill of water of a current operational cycle and measuring a temperature of the initial fill of water. The method also includes comparing the temperature of the initial fill of water to a reference temperature and calculating an energy demand for the dishwashing appliance to heat the initial fill of water to the reference temperature based on a heat rise rate. Based on the calculated energy demand, for example based on a comparison of the calculated energy demand with a predetermined energy demand for an external heating unit, the dishwashing appliance decides whether to heat the initial fill. The heat rise rate may be calculated during a characterization of the dishwashing appliance prior to the current operational cycle.

17 Claims, 6 Drawing Sheets

DISHWASHING APPLIANCES WITH HOT START FEATURES AND RELATED METHODS

FIELD

The present subject matter relates generally to washing appliances, such as dishwashing appliances and, more particularly, to a dishwashing appliance with features for efficiently providing a hot start and related methods.

BACKGROUND

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles, e.g., during the wet cycle.

Some dishwashing appliances provide hot water at the start of the wet cycle. However, water received from the plumbing system may not be sufficiently hot when the dishwashing appliance is first started, for example, due to residual cold water in the supply line between a water heater and the dishwashing appliance. In such instances, the dishwashing appliance may discard an initial fill of water when the initial fill of water is not hot enough. Due to variations in usage conditions of the dishwashing appliance, e.g., length of the supply line between the water heater and the dishwashing appliance, amount of time since the appliance or a nearby appliance or fixture connected to the same line was last used, local climate and seasonal temperature variations, etc., it may be more efficient in some instances to heat the initial fill in the dishwashing appliance rather than discarding it and re-filling the dishwashing appliance, whereas in other instances discarding and re-filling may be more efficient.

Accordingly, improved systems and methods for a dishwashing appliance which provide improved energy and water consumption would be welcomed.

BRIEF DESCRIPTION

Aspects and advantages of the technology will be set forth in part in the following description, or may be obvious from the description, or may be learned through practice of the technology.

In one embodiment, a method of operating a dishwashing appliance is provided. The method includes characterizing the dishwashing appliance. Characterizing the dishwashing appliance includes measuring an initial temperature of water in a sump of the dishwashing appliance, measuring a subsequent temperature of the water in the sump after a predetermined period of time, and calculating a heat rise rate based on the initial temperature, the subsequent temperature, and the predetermined period of time. The method further includes filling the sump of the dishwashing appliance with an initial fill of water of a current operational cycle of the dishwashing appliance after characterizing the dishwashing appliance. The method also includes measuring a temperature of the initial fill of water of the current operational cycle in the sump, comparing the temperature of the initial fill of water of the current operational cycle to a reference temperature, and calculating an energy demand for the dishwashing appliance to heat the initial fill of water of the current operational cycle to the reference temperature, based on the heat rise rate calculated during characterization of the dishwashing appliance. The method then heats the initial fill of water of the current operational cycle to the reference temperature in the dishwashing appliance based on the calculated energy demand.

In another embodiment, a method of operating a dishwashing appliance is provided. The method includes filling a sump of the dishwashing appliance with an initial fill of water of a current operational cycle of the dishwashing appliance and measuring a temperature of the initial fill of water of the current operational cycle in the sump. The method also includes comparing the temperature of the initial fill of water of the current operational cycle to a reference temperature and calculating an energy demand for the dishwashing appliance to heat the initial fill of water of the current operational cycle to the reference temperature, based on a heat rise rate of the dishwashing appliance. The method further includes comparing the calculated energy demand to a predetermined energy demand for an external heating unit to provide a fill of water to the dishwashing appliance at the reference temperature. Based on the comparison of the calculated energy demand to the predetermined energy demand, the initial fill of water of the current operational cycle is heated to the reference temperature in the dishwashing appliance when the calculated energy demand is less than the predetermined energy demand.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
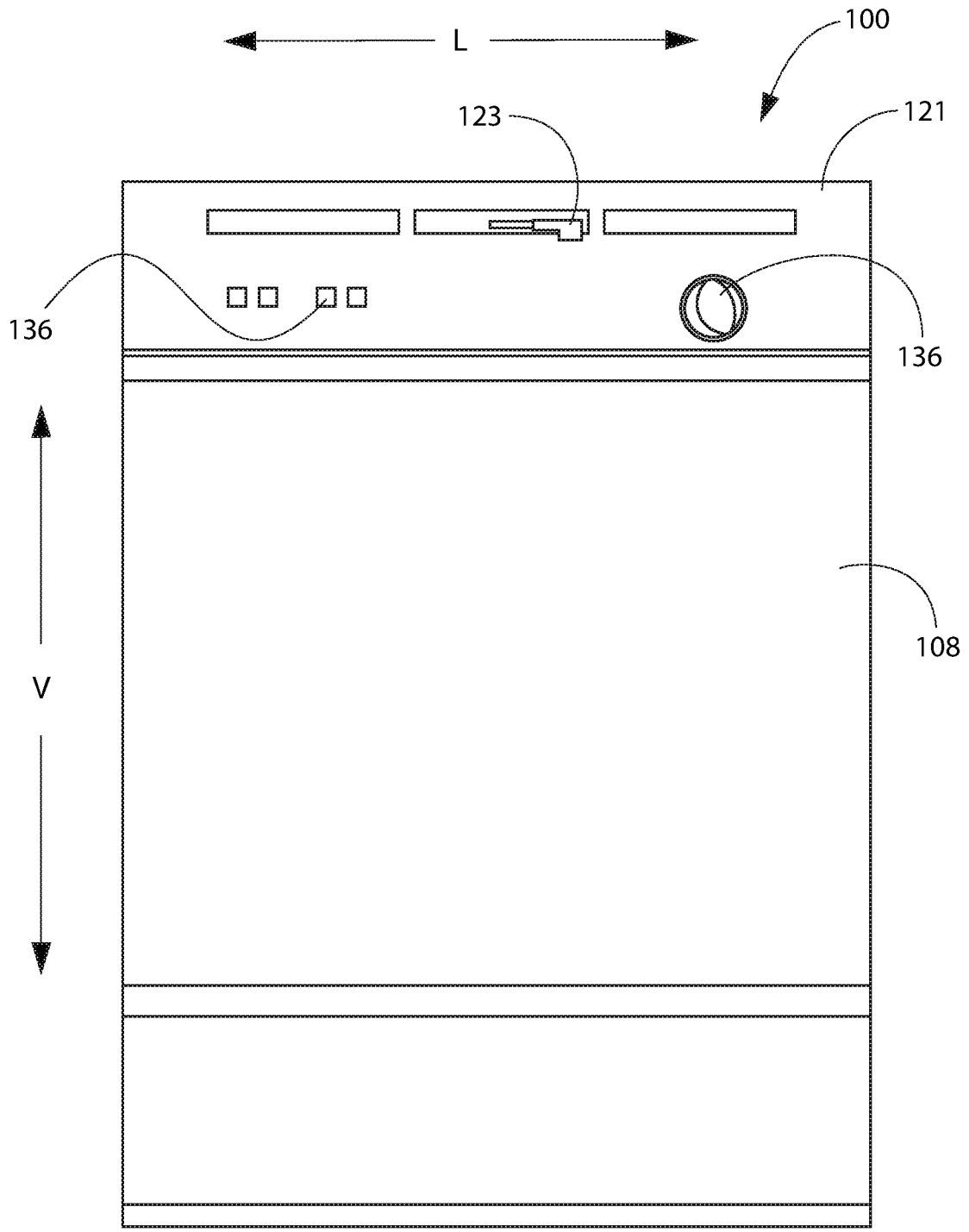
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
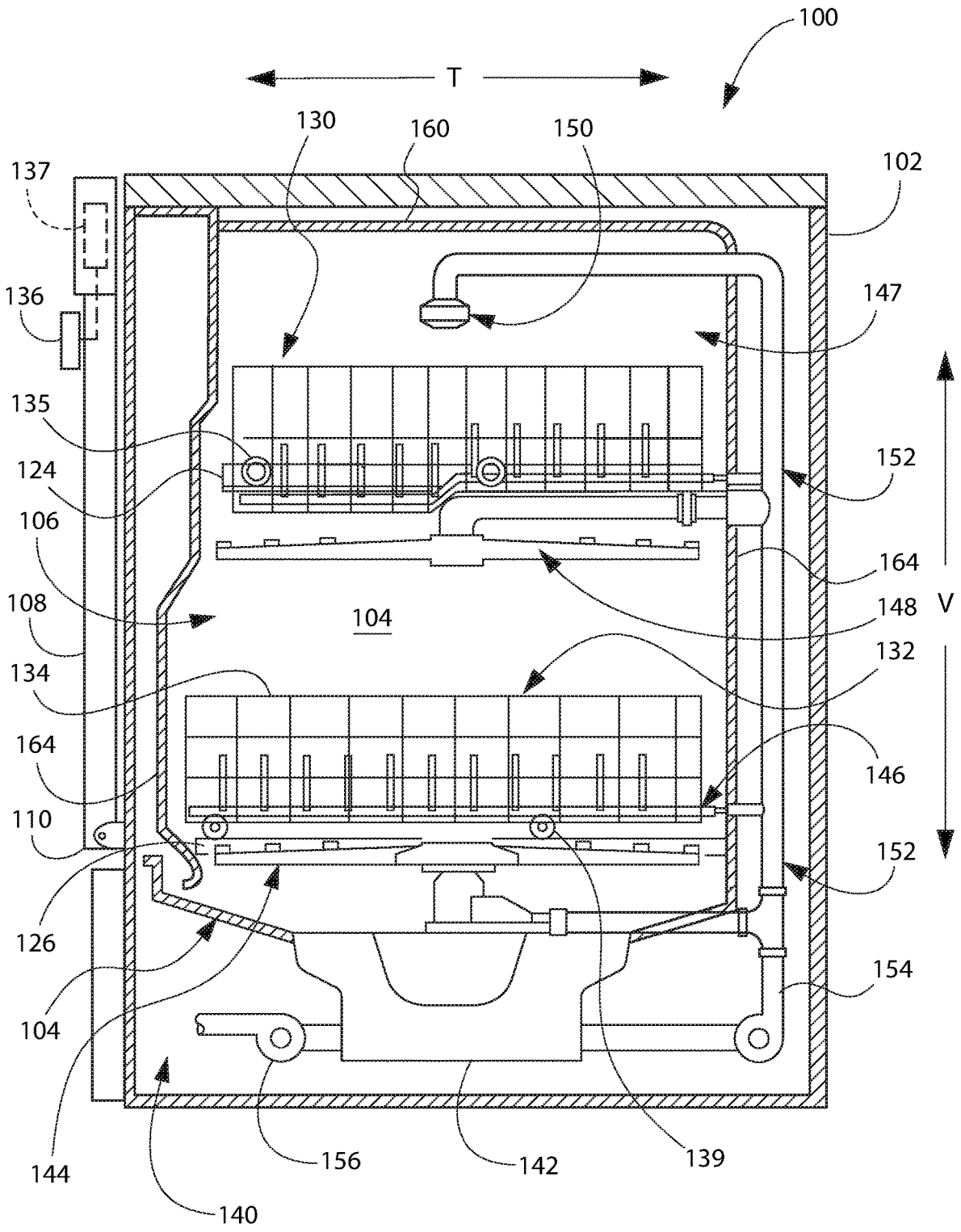
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located above the lower spray-arm assembly 144 within the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash fluid) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing fluid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Embodiments of the present disclosure also include methods of characterizing and/or operating a dishwashing appliance, such as the exemplary methods 200, 300, 400, and 500 illustrated in FIGS. 3, 4, 5, and 6. Such methods may be part of an overall wash and dry operation of the dishwashing appliance 100 and/or may be a standalone cycle such as a standalone rinse cycle.

Figure 3:
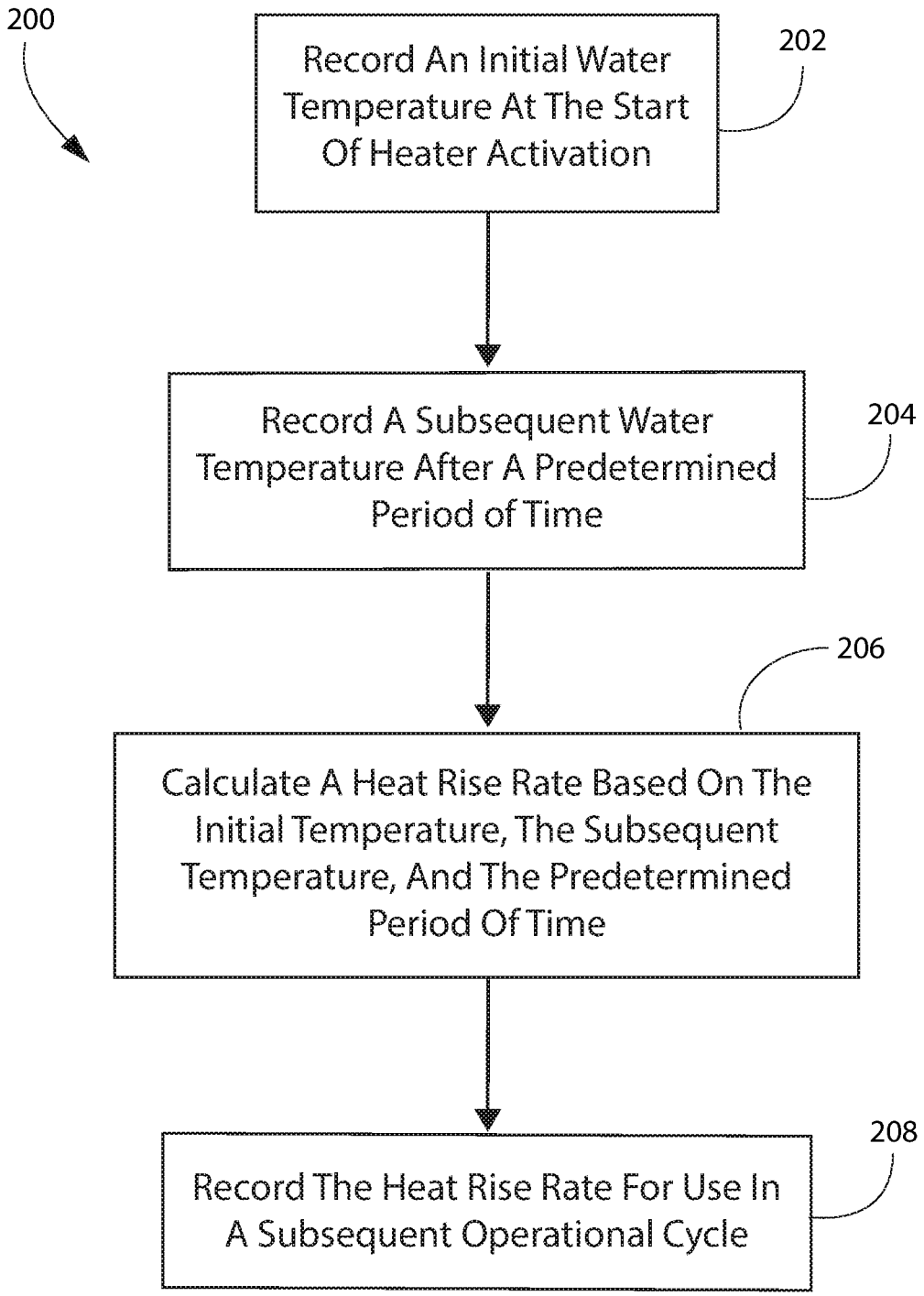
FIG. 3 provides a flowchart illustrating an exemplary method of characterizing a dishwashing appliance according to one or more embodiments of the present subject matter.

Turning now to FIG. 3, an example method 200 of characterizing a dishwashing appliance, for example the dishwashing appliance 100 depicted in FIGS. 1 and 2, is illustrated. As illustrated in FIG. 3, the method 200 may include, for example, a step 202 of measuring and recording a temperature, such as a temperature of water or wash liquid in a sump of the dishwashing appliance, when a heater is first activated, such as at the start of heater activation. The temperature recorded in step 202 may therefore be considered an initial water temperature. The heater may be, for example, a main wash heater of the dishwashing appliance. The terms "water" and "wash liquid" are generally used interchangeably herein, unless specifically indicated otherwise, such that either term may include water as well as additives, particulate matter, solutes, etc., and neither term is limited to pure or clean water.

In some embodiments, methods of characterizing the dishwashing appliance may also include circulating the water and/or wash liquid from the sump through the dishwashing appliance. For example, such circulation may be provided by activating a recirculation pump of the dishwashing appliance to motivate the water from the sump through a circulation system, e.g., including one or more spray apparatus such as a spray arm, of the dishwashing appliance. In various embodiments, such circulation may be provided before and/or after measuring and recording the initial temperature. Circulating the water from the sump through the dishwashing appliance may include circulating the water throughout a wash chamber of the dishwashing appliance, e.g., via one or more spray apparatus as mentioned, whereupon the water returns to the sump, e.g., drains to the sump by gravity when the sump is positioned at a bottom of the wash chamber. The predetermined period of time may be or correspond to a time period of an operational cycle of the dishwashing appliance, such as a wash cycle, for example.

The characterizing method 200 may also include a step 204 of measuring and recording a subsequent water temperature after a predetermined period of time, such as a predetermined period of time in a main wash cycle of the dishwashing appliance. For example, in some embodiments, methods of characterizing the dishwashing appliance may include circulating the water from the sump through the dishwashing appliance for the predetermined period of time after measuring the initial temperature of the water in the sump. Based on the initial water temperature, the subsequent water temperature, and the predetermined period of time, the method 200 may then calculate a heat rise rate of the dishwashing appliance at step 206. For example, the heat rise rate may be calculated by taking the mathematical difference between the initial water temperature and the subsequent water temperature, such as by subtracting the initial water temperature from the subsequent water temperature, and dividing that difference by the period of time. The heat rise rate thus may be expressed in terms of temperature per time, such as ° F./min, where typical heat rise rates for exemplary dishwashing appliances may range from about 1° F./min to about 2.5° F./min, purely by way of example.

As illustrated in FIG. 3, the resultant heat rise rate value may be recorded, such as in a memory of the dishwashing appliance and/or in a remote server or database, e.g., in the cloud, at step 208. The recorded heat rise rate may then be used in one or more subsequent operational cycles of the dishwashing appliance.

For example, the heat rise rate may be used in determining whether to heat an initial fill of a subsequent operational cycle in the dishwashing appliance or to drain the initial fill and re-fill the dishwashing appliance with fresh, hot water. Such determination may, in various embodiments, be based on the heat rise rate. For example, the determination may be based on a calculated energy demand which is calculated based on the heat rise rate. For example, the determination may be based on comparing the calculated energy demand to a predetermined energy demand for an external heating unit, such as a water heater, to provide a fill of water to the dishwashing appliance at a reference temperature.

Figure 4:
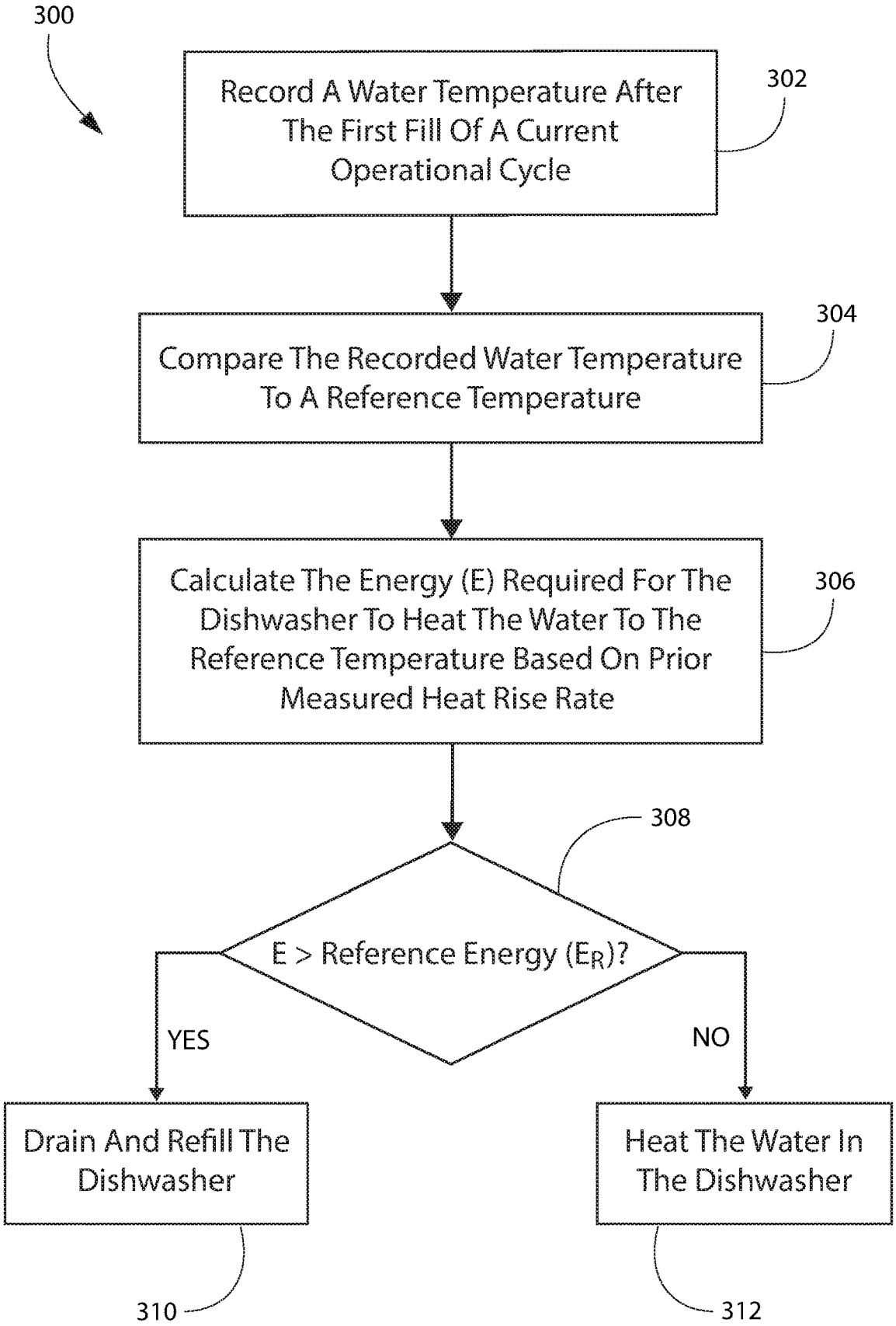
FIG. 4 provides a flowchart illustrating an exemplary method of operating a dishwashing appliance according to one or more embodiments of the present subject matter.

One example embodiment of a method 300 of operating a dishwashing appliance according to the present disclosure is illustrated in FIG. 4. As illustrated in FIG. 4, the method 300 may include a step 302 of recording a water temperature after the first fill of a current operational cycle of the dishwashing appliance. As noted above, the current operation cycle of the method of operating the dishwashing appliance may be a subsequent cycle following, such as immediately following, characterization of the dishwashing appliance. For example, the method of characterizing the dishwashing appliance may be performed during a wash cycle of the dishwashing appliance, and the current operational cycle of the dishwashing appliance in the method of operating the dishwashing appliance may be a rinse cycle immediately following the wash cycle. Thus, in various embodiments, the method of characterizing the dishwashing appliance may be performed immediately prior to operating the dishwashing appliance, and/or may be incorporated into a single method of operating the dishwashing appliance or operational cycle of the dishwashing appliance. Thus, methods according to the present disclosure may advantageously characterize the dishwashing appliance repeatedly and thereby make informed decisions as to whether to drain and re-fill the dishwashing appliance at each use of the dishwashing appliance. Thus, the present methods may account for variations in the dishwashing appliance over time, such as differing thermal mass from a different load of articles, seasonal temperature variations, etc., by repeatedly characterizing the dishwashing appliance.

As illustrated in FIG. 4, the method 300 may then include a step 304 of comparing the recorded water temperature after the first fill of the current operational cycle to a reference temperature. As used herein, "hot" water generally refers to water having a temperature of at least about 80° F., such as about 100° F. or more, such as about 110° F. or more. For example, hot water referred to herein may include water having a temperature of between about 90° F. and about 150° F. In some embodiments, the reference temperature may be between about 100° F. and about 140° F., such as between about 110° F. and about 130° F., such as about 120° F.

The method 300 may then, at step 306, calculate the energy (E) required for the dishwashing appliance to heat the system to the reference temperature. The "system" may include, e.g., the water in the sump as well as the overall thermal load in the dishwashing appliance including articles, e.g., dishes, loaded therein. The thermal load may vary over time, such as from one operation to the next, due to, e.g., the size, type, and amount of articles in the dishwashing appliance. The energy calculation may include or be based on a prior measured heat rate rise, e.g., the recorded heat rate rise from the characterization method of FIG. 3.

The method 300 may then include comparing the calculated energy (E) to a reference energy (Er). For example, the reference energy (Er) may be the energy charged to the dishwashing appliance for the energy consumed by a hot water heater to heat the inlet water (that is, incoming water to the dishwashing appliance from the hot water heater, which may be received by the dishwashing appliance via a supply line which is a part of a plumbing system, such as a residential plumbing system in a house or apartment building, where the hot water from the water heater is received by the dishwashing appliance at an inlet of the dishwashing appliance, and is thus referred to as inlet water) to the reference temperature. In at least some embodiments, comparing the calculated energy (E) to the reference energy (Er) may include determining whether the calculated energy (E) is greater than the reference energy (Er), e.g., as illustrated at step 308 in FIG. 4.

In some embodiments, when the calculated energy (E) is greater than the reference energy (Er), the method 300 may include an Auto Hot Start feature, e.g., may include draining the dishwashing appliance and re-filling the dishwashing appliance, as illustrated in FIG. 4 at 310. The Auto Hot Start feature may advantageously reduce the overall cycle time in that the water heater may provide an already-heated flow of water to the dishwashing appliance, as opposed to waiting for the heater of the dishwashing appliance to raise the temperature of the initial fill to the reference temperature.

In some embodiments, when the calculated energy (E) is not greater than, e.g., is less than, the reference energy (Er), the method 300 may include continuing the current operational cycle, such as a wash segment or rinse cycle, etc., without executing the Auto Hot Start feature, e.g., the method 300 may include heating the water in the dishwashing appliance, as illustrated in FIG. 4 at 312. Heating the water in the dishwashing appliance may advantageously reduce the water consumption associated with the operational cycle.

Figure 5:
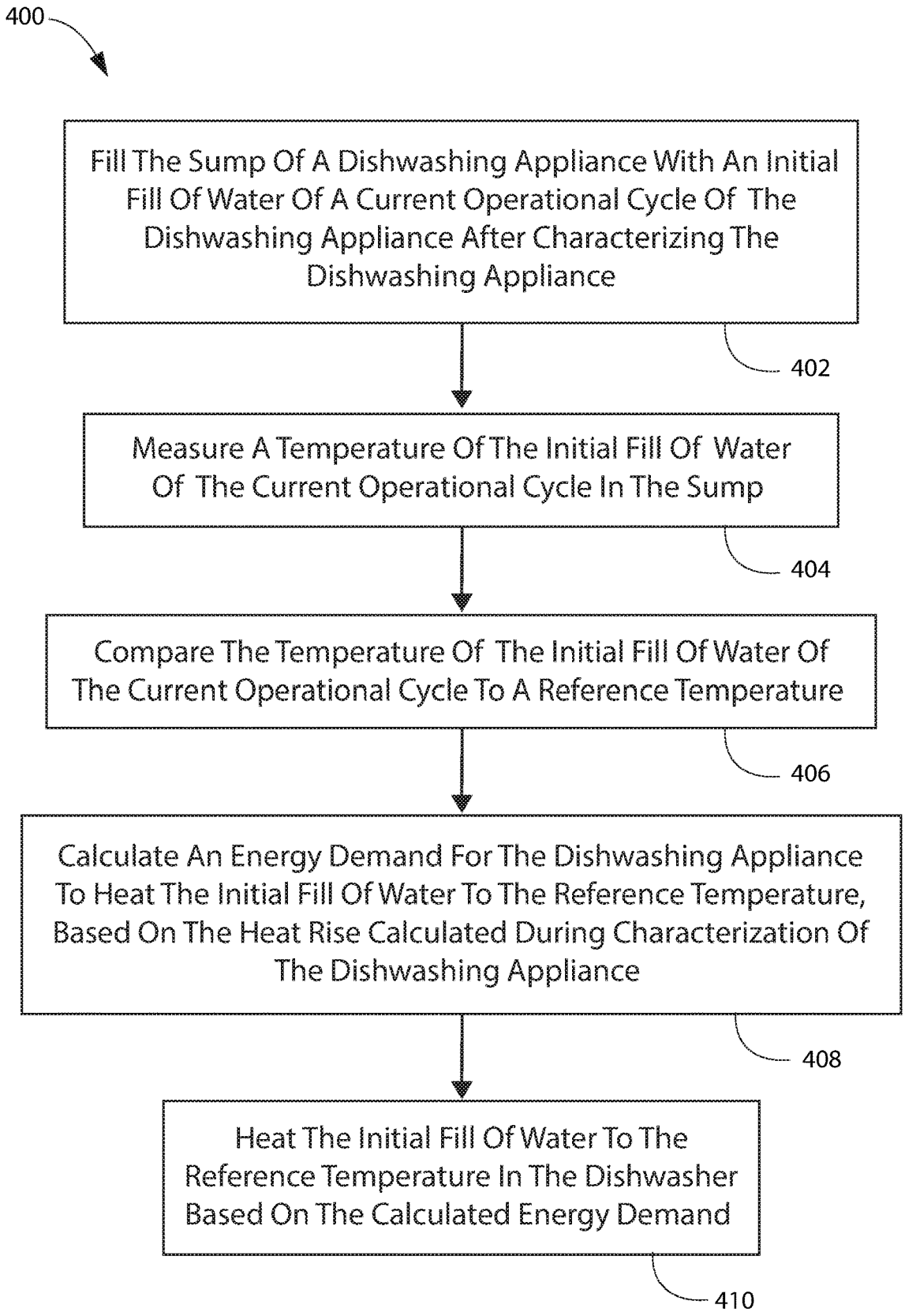
FIG. 5 provides a flowchart illustrating an exemplary method of operating a dishwashing appliance according to one or more embodiments of the present subject matter.

Turning now to FIG. 5, another example method 400 of operating a dishwashing appliance is illustrated. In at least some embodiments, the method 400 may also include characterizing the dishwashing appliance, e.g., the method 400 may include one or more characterization steps, such as steps of the method 200 illustrated in FIG. 3. For example, as will be described further below, the method 400 may include a step 408 which uses a heat rise rate obtained during characterization of the dishwashing appliance.

As illustrated in FIG. 5, the method 400 includes filling the sump of the dishwashing appliance with an initial fill of water of a current operational cycle of the dishwashing appliance at step 402. As mentioned, the method 400 may also incorporate characterizing the dishwashing appliance, and the step 402 may be performed after characterizing the dishwashing appliance. In some embodiments, the initial fill may be a partial fill. For example, the initial fill of water of the current operational cycle may be mixed with wash liquid already in the sump during the step of filling the sump of the dishwashing appliance with the initial fill of water of the current operational cycle of the dishwashing appliance.

As shown at step 404 in FIG. 5, the method 400 may also include measuring a temperature of the initial fill of water of the current operational cycle, e.g., while the water is in the sump of the dishwashing appliance. The measured temperature may, in some embodiments, also be recorded, e.g., in a memory of the dishwashing appliance. In some embodiments, the method 400 may also include circulating the initial fill of water of the current operational cycle through the dishwashing appliance before measuring the temperature of the initial fill of water of the current operational cycle. As mentioned above, the initial fill may be a partial fill mixed with wash liquid already in the sump. In such embodiments, measuring the temperature of the initial fill of water of the current operational cycle may be or include measuring the temperature of the mixture of the initial fill of water and the wash liquid already in the sump. In some embodiments, the initial fill may mix with the water already in the sump while in the sump. In other embodiments, the mixing may include circulating the water from the sump through, e.g., throughout, the dishwashing appliance.

After measuring the temperature of the initial fill, the method 400 may then include comparing the measured (recorded) temperature of the initial fill of water of the current operational cycle to a reference temperature, e.g., about 120° F. as described above, at step 406.

As illustrated at step 408 in FIG. 5, the method 400 may also include calculating an energy demand for the dishwashing appliance to heat the initial fill of water of the current operational cycle to the reference temperature. For example, the calculation may be based on the heat rise rate of the dishwashing appliance. As mentioned, the heat rise rate of the dishwashing appliance may be calculated during characterization of the dishwashing appliance, and one or more characterization steps may also be incorporated into a single method with the steps of method 400.

Finally, at step 410 in FIG. 5, the method 400 may include heating the initial fill of water of the current operational cycle to the reference temperature in the dishwashing appliance based on the calculated energy demand. For example, in some embodiments, the method 400 may also include comparing the calculated energy demand to a predetermined energy demand for an external heating unit, e.g., a water heater, to provide a fill of water to the dishwashing appliance at the reference temperature. In such embodiments, heating the initial fill of water of the current operational cycle to the reference temperature in the dishwashing appliance based on the calculated energy demand at step 410 may be or include heating the initial fill of water of the current operational cycle to the reference temperature in the dishwashing appliance based on the comparison of the calculated energy demand to the predetermined energy demand. For example, the initial fill of water of the current operational cycle may be heated in the dishwashing appliance when the calculated energy demand is less than the predetermined energy demand. Additionally, some embodiments of the method 400 may include draining the initial fill of water of the current cycle from the dishwashing appliance and filling the sump with a second fill of water based on the comparison of the calculated energy demand to the predetermined energy demand when the calculated energy demand is greater than the predetermined energy demand.

Figure 6:
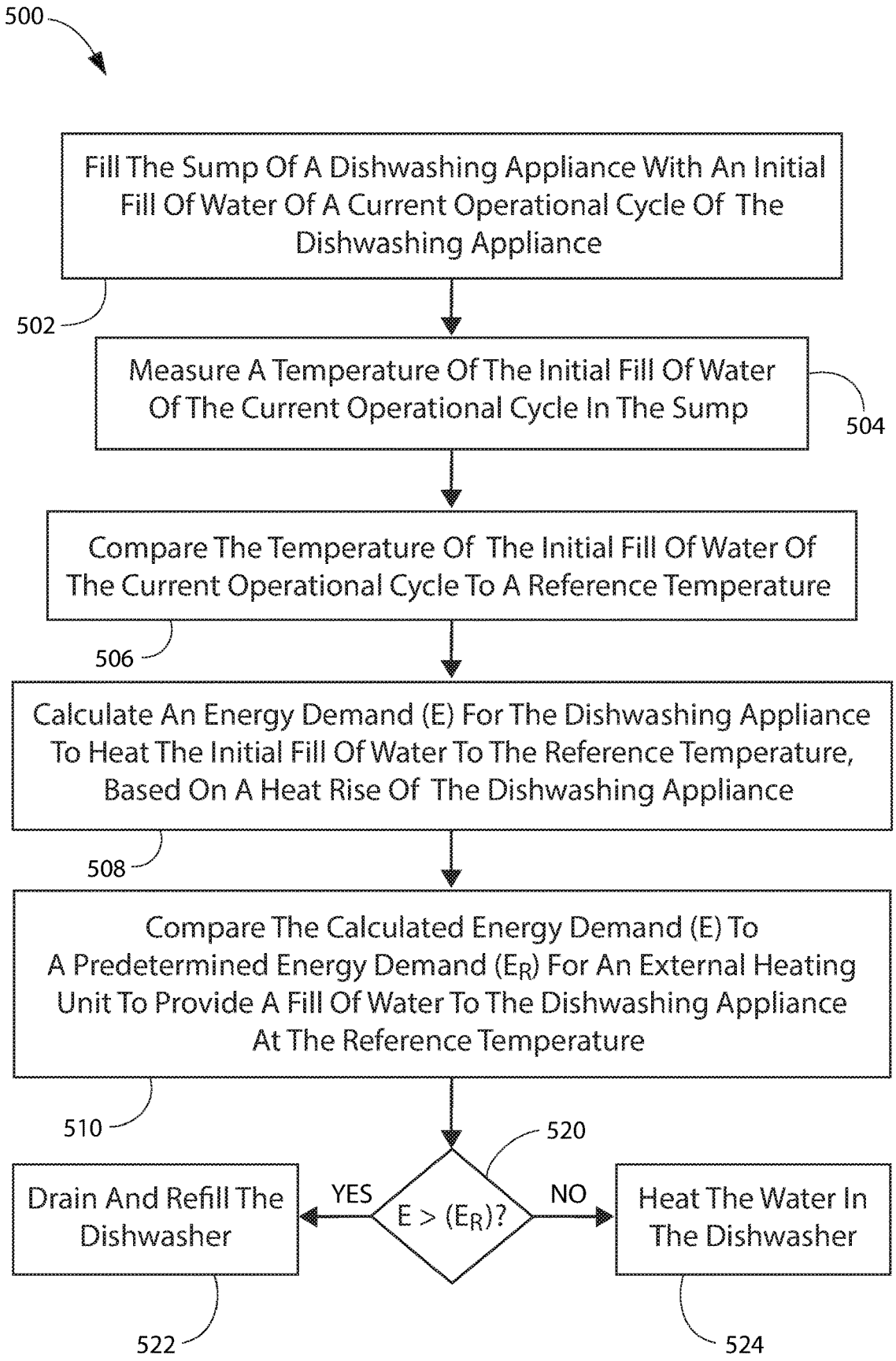
FIG. 6 provides a flowchart illustrating an exemplary method of operating a dishwashing appliance according to one or more embodiments of the present subject matter.

Turning now to FIG. 6, another example method 500 of operating a dishwashing appliance is illustrated. As noted, the method 500 of FIG. 6 may, in some embodiments, also include or incorporate one or more characterization steps. As shown in FIG. 6, the method 500 includes filling a sump of the dishwashing appliance with an initial fill of water of a current operational cycle of the dishwashing appliance at step 502. For example, in some embodiments, the sump may be filled with the initial fill after, e.g., immediately after, characterizing the dishwashing appliance, where characterization may include any or all of the characterization steps described above.

In some embodiments, the method 500 may include a step 504 of measuring a temperature of the initial fill of water of the current operational cycle in the sump. The method 500 may also include a step 506 of comparing the measured temperature of the initial fill of water of the current operational cycle to a reference temperature. The method 500 may then use a heat rise rate, e.g., that is calculated or obtained from a characterization of the dishwashing appliance, as described above, to calculate an energy demand (E) for the dishwashing appliance to heat the initial fill of water of the current operational cycle to the reference temperature based on the heat rise rate of the dishwashing appliance, as shown at 508 in FIG. 6.

The method 500 may then include a step 510 of comparing the calculated energy demand (E) to a predetermined energy demand (ER) for an external heating unit to provide a fill of water to the dishwashing appliance at the reference temperature. For example, the external heating unit may be a water heater which is typically located in a separate room or area from the dishwashing appliance, e.g., the dishwashing appliance may be located in a kitchen while the water heater is located in a garage or basement, etc.

As shown at step 520 in FIG. 6, the method 500 may also include determining whether the calculated energy demand (E) is greater than the predetermined energy demand (ER). As shown at step 522, when the calculated energy demand is greater than the predetermined energy demand, the method 500 may include draining the initial fill of water of the current cycle from the dishwashing appliance and filling the sump with a second fill of water based on, e.g., as a result of, the comparison of the calculated energy demand to the predetermined energy demand when the calculated energy demand is greater than the predetermined energy demand. As shown at step 524 in FIG. 6, the method 500 may include heating the initial fill of water of the current operational cycle to the reference temperature in the dishwashing appliance based on, e.g., as a result of, the comparison of the calculated energy demand to the predetermined energy demand when the calculated energy demand is less than or equal to, e.g., not greater than, the predetermined energy demand.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance, comprising:

characterizing the dishwashing appliance, comprising:

measuring an initial temperature of water in a sump of the dishwashing appliance;

measuring a subsequent temperature of the water in the sump after a predetermined period of time; and calculating a heat rise rate based on the initial temperature, the subsequent temperature, and the predetermined period of time;

filling the sump of the dishwashing appliance with an initial fill of water of a current operational cycle of the dishwashing appliance after characterizing the dishwashing appliance;

measuring a temperature of the initial fill of water of the current operational cycle in the sump;

comparing the temperature of the initial fill of water of the current operational cycle to a reference temperature;

calculating an energy demand for the dishwashing appliance to heat the initial fill of water of the current operational cycle to the reference temperature, based on the heat rise rate calculated during characterization of the dishwashing appliance; and heating the initial fill of water of the current operational cycle to the reference temperature in the dishwashing appliance based on the calculated energy demand.

2. The method of claim 1, wherein characterizing the dishwashing appliance comprises circulating the water from the sump through the dishwashing appliance for the predetermined period of time after measuring the initial temperature of the water in the sump.

3. The method of claim 1, further comprising comparing the calculated energy demand to a predetermined energy demand for an external heating unit to provide a fill of water to the dishwashing appliance at the reference temperature, wherein heating the initial fill of water of the current operational cycle to the reference temperature in the dishwashing appliance based on the calculated energy demand comprises heating the initial fill of water of the current operational cycle to the reference temperature in the dishwashing appliance based on the comparison of the calculated energy demand to the predetermined energy demand when the calculated energy demand is less than the predetermined energy demand.

4. The method of claim 1, wherein the reference temperature is about one hundred and twenty degrees Fahrenheit (120° F.).

5. The method of claim 1, wherein the initial fill of water of the current operational cycle is mixed with wash liquid already in the sump during the step of filling the sump of the dishwashing appliance with the initial fill of water of the current operational cycle of the dishwashing appliance.

6. The method of claim 1, further comprising circulating the initial fill of water of the current operational cycle through the dishwashing appliance before measuring the temperature of the initial fill of water of the current operational cycle.

7. The method of claim 1, wherein characterizing the dishwashing appliance is performed during a wash cycle of the dishwashing appliance, and wherein the current operational cycle of the dishwashing appliance is a rinse cycle immediately following the wash cycle.

8. The method of claim 3, further comprising draining the initial fill of water of the current cycle from the dishwashing appliance and filling the sump with a second fill of water based on the comparison of the calculated energy demand to the predetermined energy demand when the calculated energy demand is greater than the predetermined energy demand.

9. The method of claim 5, wherein measuring the temperature of the initial fill of water of the current operational cycle comprises measuring the temperature of the mixture of the initial fill of water and the wash liquid already in the sump.

10. A method of operating a dishwashing appliance, the method comprising:

filling a sump of the dishwashing appliance with an initial fill of water of a current operational cycle of the dishwashing appliance;

measuring a temperature of the initial fill of water of the current operational cycle in the sump;

comparing the temperature of the initial fill of water of the current operational cycle to a reference temperature;

calculating an energy demand for the dishwashing appliance to heat the initial fill of water of the current operational cycle to the reference temperature, based on a heat rise rate of the dishwashing appliance calculated during a characterization of the dishwashing appliance prior to the current operational cycle;

comparing the calculated energy demand to a predetermined energy demand for an external heating unit to provide a fill of water to the dishwashing appliance at the reference temperature; and heating the initial fill of water of the current operational cycle to the reference temperature in the dishwashing appliance based on the comparison of the calculated energy demand to the predetermined energy demand when the calculated energy demand is less than the predetermined energy demand, wherein characterization of the dishwashing appliance comprises:

measuring an initial temperature of water in the sump of the dishwashing appliance;

measuring a subsequent temperature of the water in the sump after a predetermined period of time; and calculating the heat rise rate based on the initial temperature, the subsequent temperature, and the predetermined period of time.

11. The method of claim 10, wherein characterization of the dishwashing appliance further comprises circulating the water from the sump through the dishwashing appliance for the predetermined period of time after measuring the initial temperature of the water in the sump.

12. The method of claim 10, further comprising draining the initial fill of water of the current cycle from the dishwashing appliance and filling the sump with a second fill of water based on the comparison of the calculated energy demand to the predetermined energy demand when the calculated energy demand is greater than the predetermined energy demand.

13. The method of claim 10, wherein the reference temperature is about one hundred and twenty degrees Fahrenheit (120° F.).

14. The method of claim 10, wherein the initial fill of water of the current operational cycle is mixed with wash liquid already in the sump during the step of filling the sump of the dishwashing appliance with the initial fill of water of the current operational cycle of the dishwashing appliance.

15. The method of claim 10, further comprising circulating the initial fill of water of the current operational cycle through the dishwashing appliance before measuring the temperature of the initial fill of water of the current operational cycle.

16. The method of claim 10, wherein characterizing the dishwashing appliance is performed during a wash cycle of the dishwashing appliance, and wherein the current operational cycle of the dishwashing appliance is a rinse cycle immediately following the wash cycle.

17. The method of claim 14, wherein measuring the temperature of the initial fill of water of the current operational cycles comprises measuring the temperature of the mixture of the initial fill of water and the wash liquid already in the sump.

* * * * *